US005215445A

United States Patent [19]

Chen

[11] Patent Number: 5,215,445

[45] Date of Patent: Jun. 1, 1993

[54] HANDY VACUUM PUMP AND HEAT SEALER COMBINATION DEVICE

[76] Inventor: Chia-Sing Chen, No. 2, Lane 61, Chu Kuang Rd., Taipei, Taiwan

[21] Appl. No.: 967,393

[22] Filed: Oct. 28, 1992

[51] Int. Cl.[5] ..... F04B 35/04; B65B 51/10; B65B 31/06

[52] U.S. Cl. ..... 417/313; 417/411; 53/375.9; 53/390; 53/512

[58] Field of Search ..... 417/234, 313, 411; 53/434, 479, 512, 390, 375.9

[56] References Cited

U.S. PATENT DOCUMENTS 2,245,015 6/1941 Sibal ..... 417/411
3,648,740 3/1972 Pruitt ..... 53/512
4,745,730 5/1988 Bartle ..... 53/512
4,765,125 8/1988 Fafournoux ..... 53/512
4,928,829 5/1990 DiBernardo ..... 53/512
5,035,103 7/1991 Akkala ..... 53/512

*Primary Examiner*—Richard A. Bertsch
*Assistant Examiner*—Roland McAndrews
*Attorney, Agent, or Firm*—Bacon & Thomas

[57] ABSTRACT

A handy vacuum pump and heat sealer combination device drawing off air from a thermoplastic bag and sealing food inside the thermoplastic bag. The device includes a cylindrical casing to hold a heat sealer, a battery power supply and a vacuum pump. The vacuum pump includes a piston reciprocated by a transmission rod and a flywheel through a motor to draw off air from a thermoplastic bag for making it into a vacuum status. The heat sealer includes a head having a sealing tip extended out of the cylindrical casing and electrically connected to the battery power supply to produce heat for sealing thermoplastic bags.

2 Claims, 7 Drawing Sheets

HANDY VACUUM PUMP AND HEAT SEALER COMBINATION DEVICE

BACKGROUND OF THE INVENTION

The present invention relates to a handy vacuum pump and heat sealer combination device for use with thermoplastic bags in packing home foods in a vacuum status.

A refrigerator is commonly used for keeping food cool to preserve it from going bad. However, the original taste of a food may be lost quickly if it is directly put in a refrigerator. Therefore, people commonly use polyethylene film or polyvinylidene chloride film to wrap a food before putting it in a refrigerator. However, the food still can not be preserved fresh for a satisfactory length of time because it is disposed in contact with the air remained inside the wrapper. It is known that a food can be preserved fresh for a length of time if it is kept away from air. However, it is not easy to a housekeeper to keep food in a vacuum status, namely, in a vacuum container.

SUMMARY OF THE INVENTION

The present invention has been accomplished under the aforesaid circumstances. It is therefore an object of the present invention to provide a handy vacuum pump and heat sealer combination device which is practical in use with thermoplastic bags for packing foods in vacuum status. It is another object of the present invention to provide a handy vacuum pump and heat sealer combination device which is suitable for home use. The present invention is to combine a small scale heat sealer and a small scale vacuum pump into a handy device and use a battery power supply to provide the heat sealer and the vacuum pump with electricity. As a food was packed inside a thermoplastic bag, the vacuum pump is operated to draw off air from the thermoplastic bag, and then the heat sealer is used to seal the thermoplastic bag. Therefore, the food is kept in a vacuum status and can be preserved for a satisfactory length of time.

DETAILED DESCRIPTION OF THE PREFERRED EMBODIMENT

Figure 1:
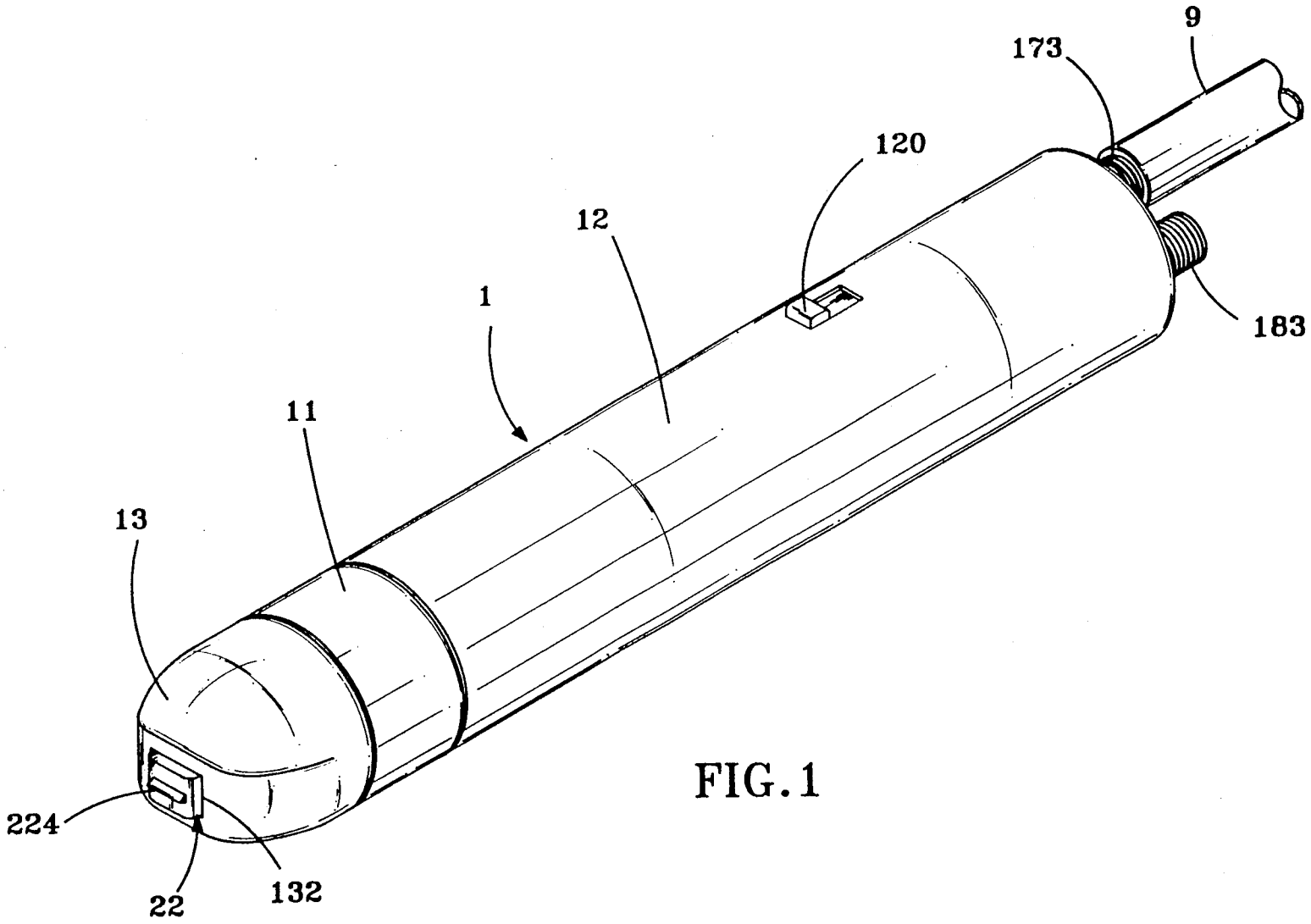
FIG. 1 is an elevational view of a handy vacuum pump and heat sealer combination device embodying the present invention.
Figure 2:
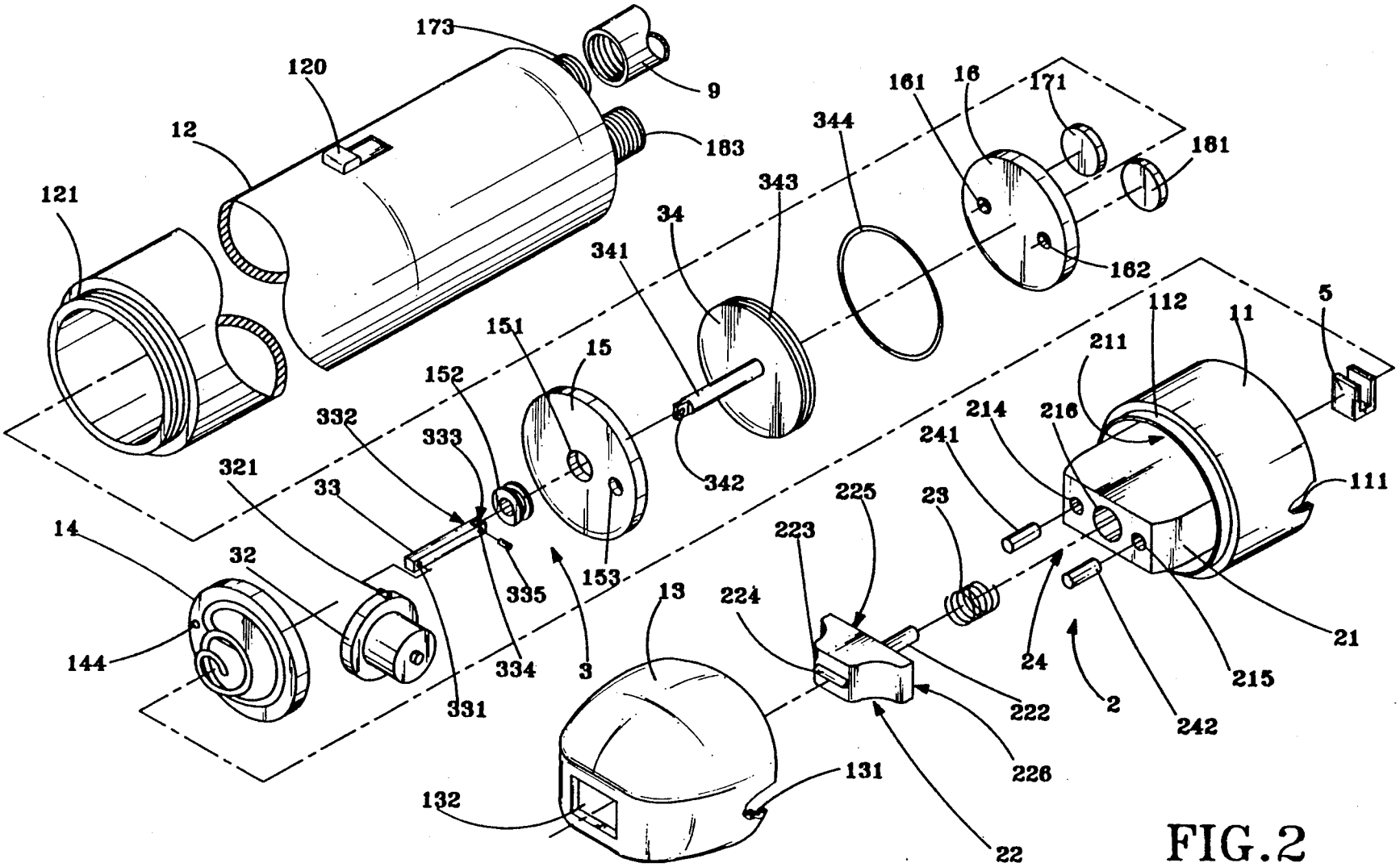
FIG. 2 is a perspective exploded view thereof.
Figure 3:
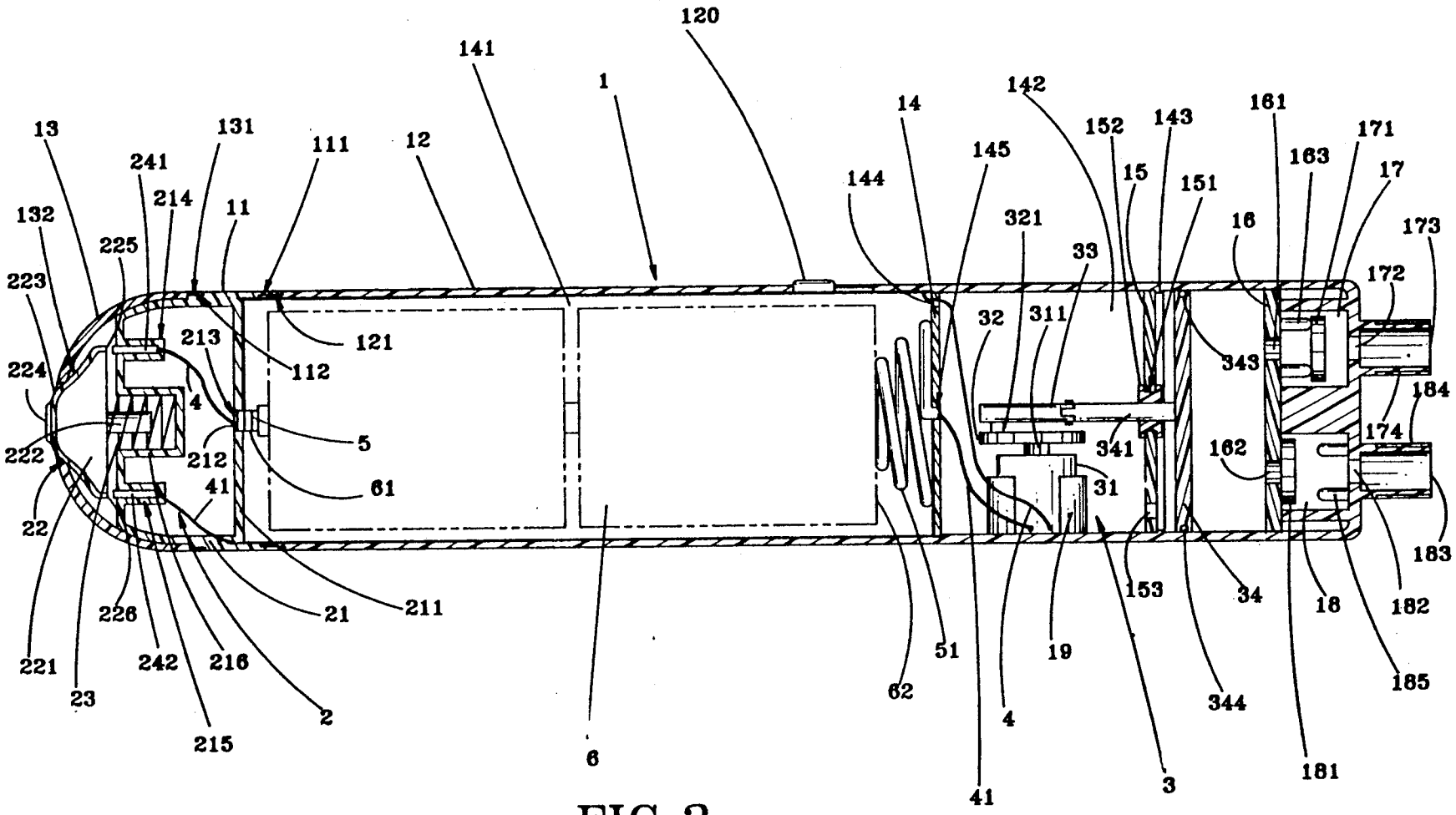
FIG. 3 is a cross section of the handy vacuum pump and heat sealer combination device in longitudinal direction showing the back stroke of the piston of the vacuum pump.
Figure 4:
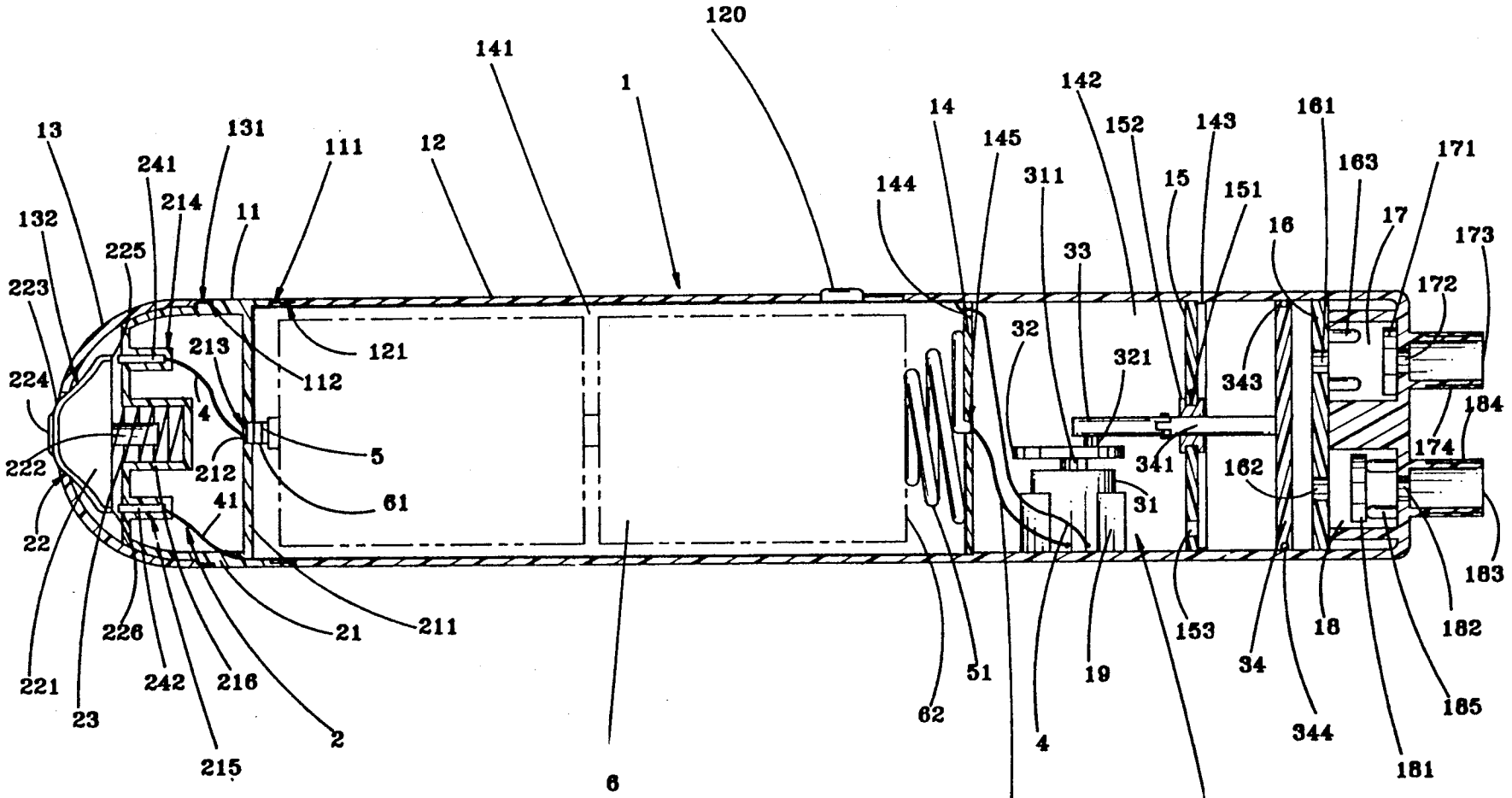
FIG. 4 is another cross section of the handy vacuum pump and heat sealer combination device showing the forward stroke of the piston of the vacuum pump.

Referring to FIGS. 1, 2, 3 and 4, therein illustrated is a handy vacuum pump and heat sealer combination device according to the present invention which is generally comprised of a heat sealer 2 and a vacuum pump 3 respectively fastened inside a cylindrical housing 1.

The cylindrical housing 1 is consisted of a cylindrical casing 12, a socket 11 and a cap 13. The socket 11 has an inner thread 111 on a rear end thereof into which an outer thread 121 on a front end of the cylindrical casing 12 is threaded, and a projecting flange 112 extended from the inside wall out of a front end thereof and fitted into an annular groove 131 on a rear end of the cap 13. The cap 13 is made in the shape of a smoothly curved covering covered over the front end (namely, the projecting flange 112) of the socket 11, having a square through hole 132 through a front end thereof. As the cap 13 and the socket 11 are connected together, a holding space is defined on the inside for holding the heat sealer 2. The cylindrical casing 12 has a first division board 14, a second division board 15 and a third division board 16 spaced on the inside. A battery chamber 141 is defined between the first division board 14 and the front end of the cylindrical casing 12. A vacuum pump storage chamber 142 is defined between the first division board 14 and the third division board 16 for holding the vacuum pump 3. The second division board 15 is retained inside the vacuum pump storage chamber 142 by inside ribs 143 of the cylindrical casing 12. An input air chamber 17 and an output air chamber 18 are defined between the third division board 16 and the closed rear end of the cylindrical casing 12 and connected to an intake pipe 173 and an exhaust pipe 183 through an intake port 172 and an exhaust port 182 respectively. The intake pipe 173 and the exhaust pipe 183 are respectively made with an outer thread 174 or 184 for mounting a hose or the like. Valve flaps 171,181 are respectively set inside the input air chamber 17 and the output air chamber 18. The first division board 14 has a through hole 144 adjacent to the border thereof, through which a positive conductor 4 is inserted, and a center hole 145, through which one end of a presser spring 51 in the battery chamber 141 is inserted and welded to a negative conductor 41. The positive and negative conductors 4,41 are respectively connected to a switch 120 on the cylindrical casing 12. The second division board 15 has a circular center hole 151, into which an axle bush 152 fits, and a vent hole 153 spaced from the circular center hole 151. The third division board 16 has an outlet hole 161 and an inlet hole 162 respectively connected to the input air chamber 17 and the output air chamber 18, and a stop member 163 projected into the input air chamber 17 to stop the valve flap 171 from the outlet hole 161. There is also provided a stop member 185 inside the output air chamber 18 to stop the valve flap 181 from the exhaust port 182.

The heat sealer 2 is generally comprised of a base 21, a head 22, a coiled spring 23, and a set of conductive rods 24. The base 21 is made in a hollow structure having a circular bottom 211 fitted into the socket 11. The circular bottom 211 of the base 21 has a through hole 212 through a chamber 213 on the center thereof. A positive contact plate 5 is fastened to the chamber 213 and stopped against the positive terminal 61 of a battery set 6, which is stored in the battery chamber 141. The negative terminal 62 of the battery set 6 is stopped against the presser spring 51. The base 21 of the heat sealer 2 further has two round holes 214,215 on the top, into which a positive conductive rod 241 and a negative conductive rod 242 of the conductive rod set 24 are inserted respectively, and a top center hole 216 between the round holes 214,215 to hold the coiled spring 23 for permitting the head 22 to be supported by the coiled spring 23 above the base 21. The conductive rod 241 or 242 has a top end extended out of the respective round hole 214 or 215 and a bottom end connected to the positive contact plate 5 through the positive conductor 4 or the presser spring 51 through the negative conductor 41. Therefore, the conductive rods 241,242 form into a switch for controlling the operation of the heat sealer 2. The head 22 of the heat sealer 2 has an insulator 221 on the inside, a stem 222 on the bottom inserted through the coiled spring 23 into the top center hole 216 on the base 21, and a conductive outer layer 223 covered over the outside surface thereof. The conductive outer layer 223 has a front portion formed into a sealing tip 224 and a rear portion formed into two contacts, namely, the positive contact 225 and the negative contact 226 respectively connected to the positive conductive rod 241 and the negative conductive rod 242. When assembled, the sealing tip 224 projects through the square through hole 132 on the cap 13. As the two contacts 225,226 of the head 2 are electrically connected to the two opposite terminals 61,62 of the battery set 6, the sealing tip 224 is heated for sealing a plastic bag or the like.

The vacuum pump 3 is generally comprised of a motor 31, a flywheel 32, a transmission rod 33, and a piston 34. The motor 31 has two opposite ends respectively connected to the positive conductor 4 and the negative conductor 41 through the switch 120. The flywheel 32 is coupled to the motor shaft 311 of the motor 31, having an eccentric rod 321 fitted into a hole 331 on one end of the transmission rod 33. The opposite end 332 of the transmission rod 33 has a groove 333 on the end edge thereof and a pivot hole 333 across the groove 333. The piston 34 has a pin hole 342 on the piston rod 341 thereof inserted through the axle bush 152 on the circular center hole 151 of the second division board 15 into the groove 333 on the transmission rod 33 and connected to the pivot hole 333 by a lock pin 335, and an annular groove 343 around a peripheral edge thereof mounted with an air piston ring 344 fitted into the cylindrical casing 12 between the second division board 15 and the third division board 16. Rotating the motor 32 causes the transmission rod 33 to reciprocate the piston 34. As the piston 34 is reciprocated, the valve flaps 171,181 are simultaneously moved back and forth for letting air be drawn into the input air chamber 17 or out of the output air chamber 18.

Figure 5:
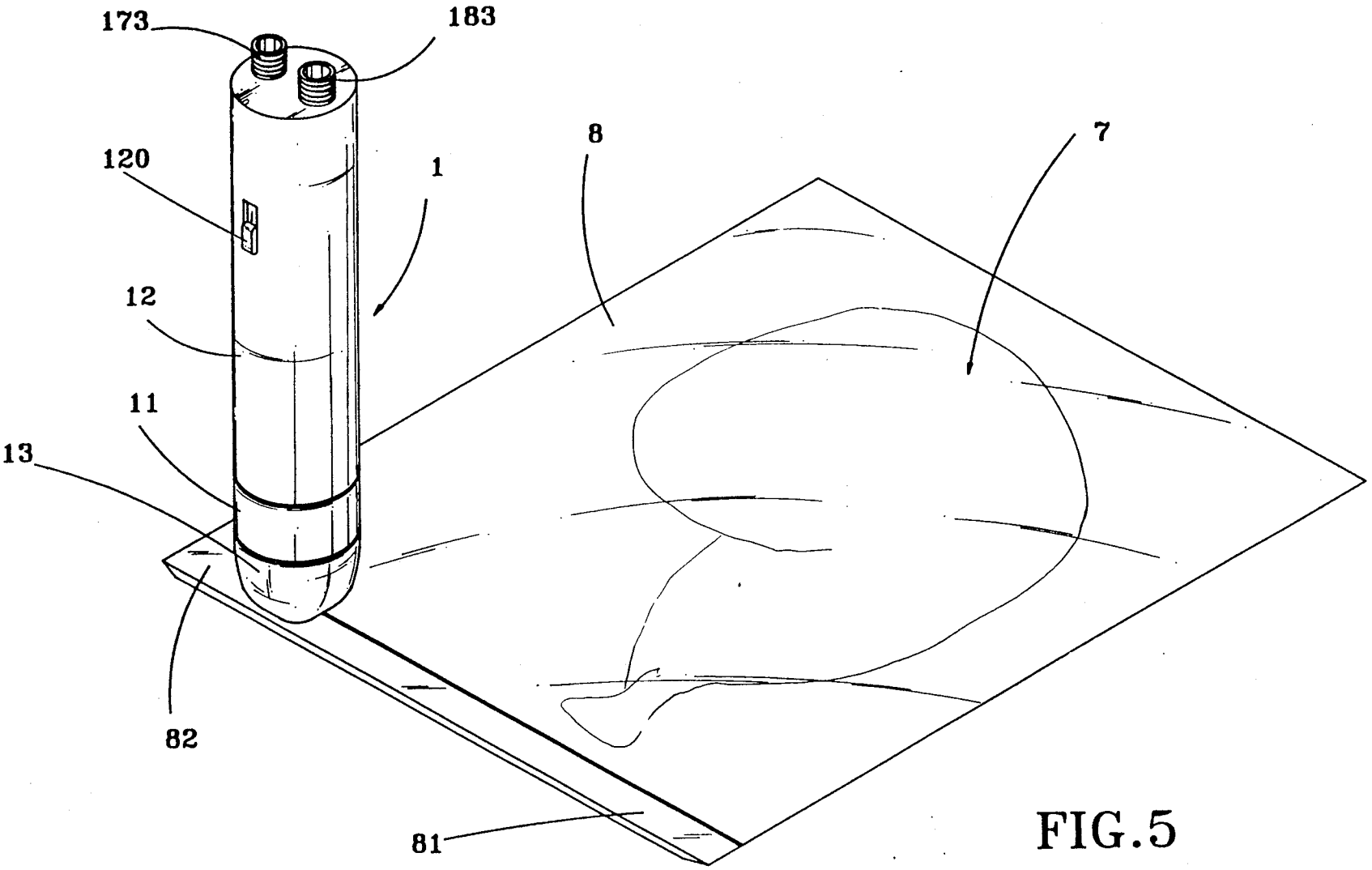
FIG. 5 illustrates the operation of the device used to press the heat sealer along the opening of a plastic bag in making a seam.
Figure 6:
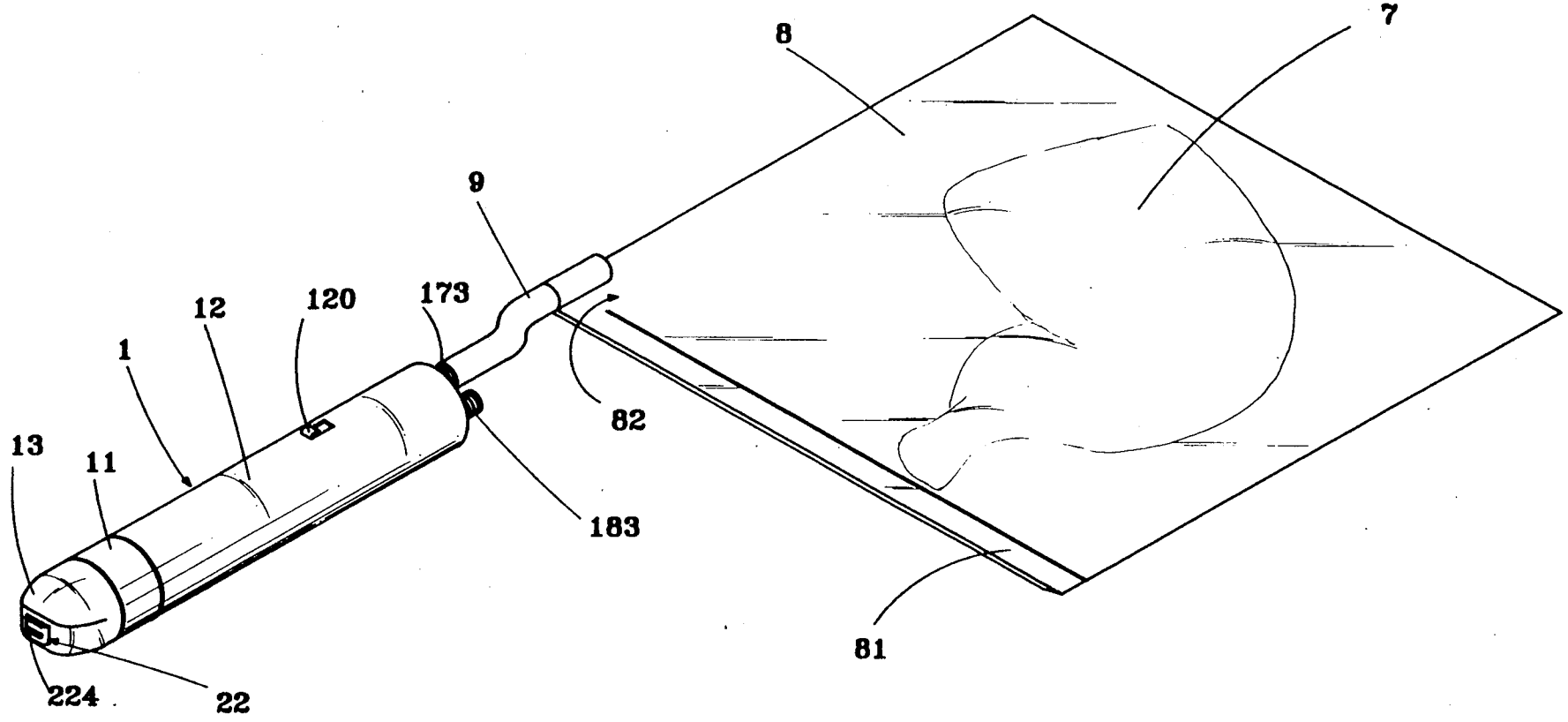
FIG. 6 illustrates the operation of the device used to draw off air from the plastic bag.
Figure 7:
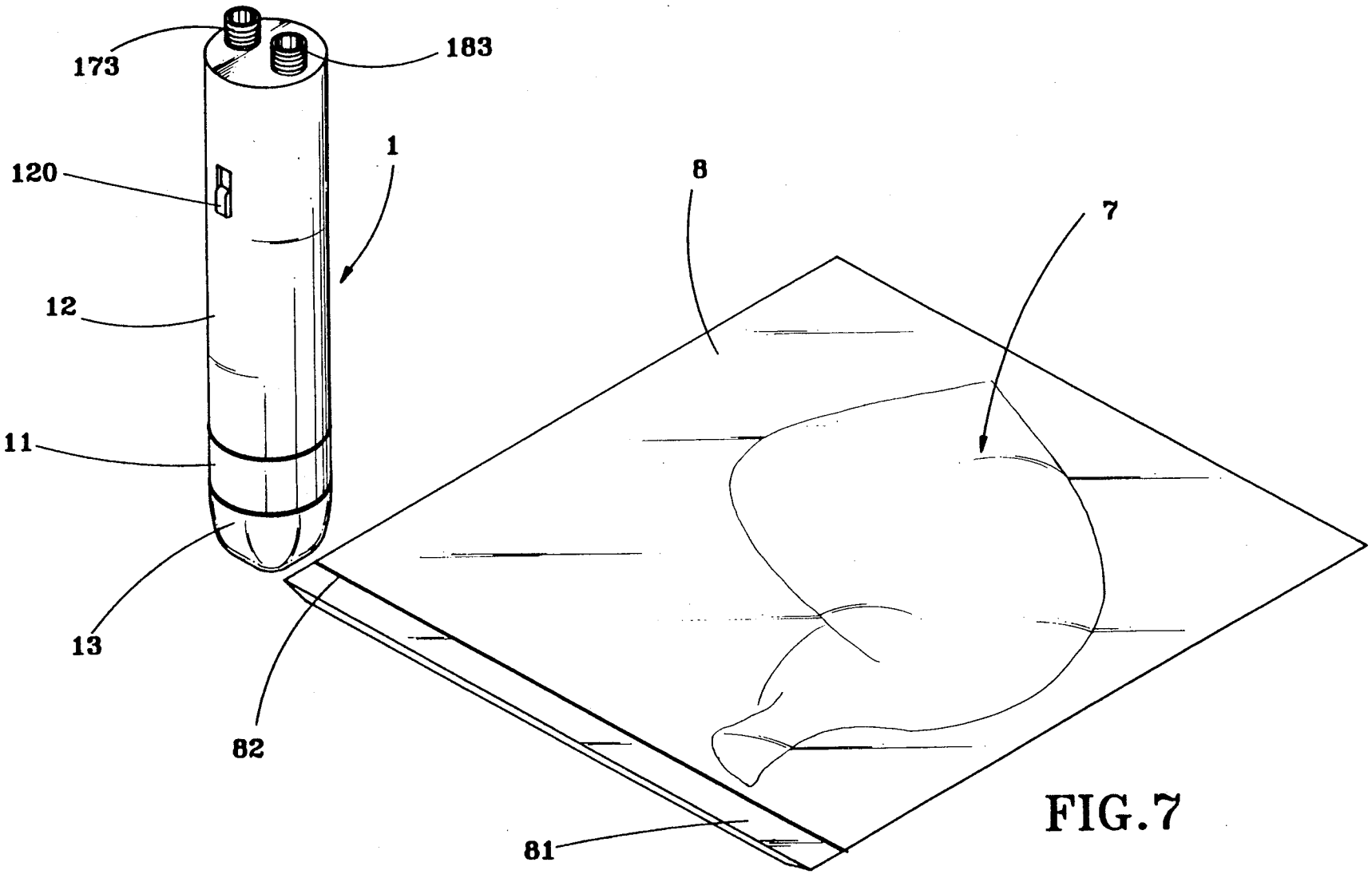
FIG. 7 illustrates the plastic bag completely sealed after it was treated into a vacuum status.

The operation of the present invention is simple and outlined hereinafter with reference to FIGS. 5, 6 and 7. The food 7 to be preserved is put in a plastic bag 8, then press the sealing tip 224 of the heat sealer 2 along the opening of the plastic bag 8. As the sealing tip 224 is squeezed, the contacts 225,226 on the head 22 become respectively and electrically connected to the two conductive rods 241,242 on the base 21, and therefore the sealing tip 224 is electrically heated to make a seam 81 along the opening of the plastic bag 8. While sealing the plastic bag 8, a small gap 82 should be left for inserting a hose. As the seam 81 was made, the intake pipe 173 is attached with a hose 9 and inserted into the plastic bag 8 through the gap 82, then the motor 31 is turned on, by means of the control of the switch 120, to reciprocate the piston 34 via the transmission rod 33 and the flywheel 32. As the piston 34 is moved from the outlet hole 161 and the inlet hole 162 on the third division board 16, the valve flaps 171,181 are respectively sucked, causing the inlet hole 162 to be sealed by the valve flap 181. Because the valve flap 171 is stopped by the stop member 163, the outlet hole 161 is still opened as the inlet hole 162 is sealed, and therefore a current of air is drawn out of the plastic bag 8 through the hose 9. At the same time, a current of air is squeezed out of the space between the second division board 15 and the third division board 16 by the piston 34 through the vent hole 153 for cooling the motor 31. As the piston 34 is moved toward the outlet hole 161 and the inlet hole 162 on the third division board 16, the valve flaps 171,181 are simultaneously moved forward, causing the intake port 172 to be sealed by the valve flap 171. Because the valve flap 181 is stopped by the stop member 185, the exhaust port 182 is still opened as the intake port 172 is sealed, and therefore a current of air is squeezed out of the output air chamber 18 through the exhaust pipe 183. Repeating the aforesaid procedure causes the plastic bag 8 to be treated into a vacuum condition. Then, remove the hose 9 from the plastic bag 8 and use fingers to stop the gap 82, and then use the heat sealer 2 to seal the gap 82. Therefore, the food 7 becomes packed in the plastic bag 8 in a vacuum status.

I claim:

1. A handy vacuum pump and heat sealer combination device comprising a housing, a heat sealer and a vacuum pump fastened inside said housing at two opposite ends thereof, and a power supply unit fastened inside said housing between said heat sealer and said vacuum pump and electrically connected to said heat sealer and said vacuum pump by means of the control of a switch means, wherein:

said housing comprises a longitudinal holding space divided into a front chamber to hold said heat sealer, a rear chamber to hold said vacuum pump, and an intermediate chamber to hold said power supply unit, said rear chamber being divided into a first chamber, a second chamber and a third chamber, said third chamber being divided into an input air chamber and an output air chamber, said input air chamber having an intake port extended to the outside and controlled by a check valve and an outlet hole communicated with said second chamber, said output air chamber having an exhaust port extended to the outside and an inlet hole communicated with said second chamber and controlled by a check valve;

said heat sealer comprises a sealing head supported on a base by a spring, said base having two conductive rods respectively connected to a positive terminal and negative terminal of said power supply unit, said sealing head having a sealing tip on a front end thereof extended out of said front chamber through an opening thereof and two contacts respectively connected to said sealing tip and spaced from said two conductive rods, said sealing tip being electrically connected to produce heat for making a seam on thermoplastic surfaces as said sealing tip is squeezed against said base in connecting the two contacts on said sealing head to the two conductive rods on said base;

said vacuum pump comprises a motor fastened inside said first chamber, a flywheel coupled to an output shaft on said motor, a piston fastened inside said second chamber, said piston having a piston rod inserted through an axle bush on a hole on said second chamber and extended into said first chamber, and a transmission rod having one end pivoted to an eccentric rod on said flywheel and an opposite end coupled to said piston rod, said piston being reciprocated to draw a current of air from a thermoplastic bag into said input air chamber through said intake port and squeeze it out of said output air chamber through said exhaust port for permitting said thermoplastic bag to be formed into a vacuum status.

2. The handy vacuum pump and heat sealer combination device of claim 1 wherein said second chamber of said rear chamber has a vent hole communicated with said first chamber for permitting a current of air to be squeezed into said first chamber for cooling said motor during the reciprocating movement of said piston.

* * * * *